US011001421B1

(12) United States Patent
Findeisen

(10) Patent No.: US 11,001,421 B1
(45) Date of Patent: May 11, 2021

(54) CUP WITH HOLE: APPARATUS AND METHODS

(71) Applicant: Kurt Charles Findeisen, Los Angeles, CA (US)

(72) Inventor: Kurt Charles Findeisen, Los Angeles, CA (US)

( * ) Notice: Subject to any disclaimer, the term of this patent is extended or adjusted under 35 U.S.C. 154(b) by 149 days.

(21) Appl. No.: 16/130,913

(22) Filed: Sep. 13, 2018

Related U.S. Application Data

(60) Provisional application No. 62/558,011, filed on Sep. 13, 2017.

(51) Int. Cl.
*B65D 41/32* (2006.01)
*B65D 47/20* (2006.01)
*B65D 43/02* (2006.01)

(52) U.S. Cl.
CPC ..... *B65D 47/2018* (2013.01); *B65D 43/0272* (2013.01); *B65D 2543/00037* (2013.01); *B65D 2543/0062* (2013.01); *B65D 2543/00092* (2013.01); *B65D 2543/00296* (2013.01); *B65D 2543/00333* (2013.01)

(58) Field of Classification Search
CPC ..... B65D 75/58; B65D 75/5855; B65D 47/2018; B65D 2543/00037; B65D 2543/00333; B65D 2543/0062; B65D 43/0272
USPC ..... 220/714
See application file for complete search history.

(56) References Cited

U.S. PATENT DOCUMENTS

| | | | | |
|---|---|---|---|---|
| 2,948,453 | A | 9/1960 | Drown | |
| 3,524,566 | A * | 8/1970 | Parks | B65D 47/36 220/268 |
| 3,558,033 | A | 1/1971 | Leeds | |
| 3,797,696 | A | 3/1974 | Dibrell | |
| 4,186,842 | A | 2/1980 | Albert | |
| 4,301,926 | A | 11/1981 | Chung | |
| 5,007,231 | A | 4/1991 | Ingemann | |
| 2006/0049127 | A1 * | 3/2006 | Katz | B65D 81/3211 215/6 |
| 2008/0179334 | A1 * | 7/2008 | Abramson | B01F 15/00512 220/568 |

* cited by examiner

*Primary Examiner* — King M Chu
(74) *Attorney, Agent, or Firm* — Law Offices of J. Curtis Edmondson; J. Curtis Edmondson

(57) ABSTRACT

A cup with hole apparatus and method comprising the parts and the steps to create a beverage cup that is inexpensive to purchase, ship, and use within a standard restaurant. One of these parts is a container that, when not assembled with other parts, cannot contain liquid due to multiple openings of different sizes. At least one of these openings is relatively smaller than the rest, and is only suitable to be used for drinking purposes. The other relatively larger openings can be used for filling purposes. A single-use beverage cup is created when: 1. A removable part is used to plug the relatively smaller opening; 2. The resulting container is filled via one of the relatively larger openings; 3. Once filled, permanent parts are used to plug all of the unplugged openings; 4. A drinker dislodges the removable part to drink from the smaller opening; and 5. Refilling the cup via the unplugged smaller opening is difficult.

5 Claims, 7 Drawing Sheets

CUP WITH HOLE: APPARATUS AND METHODS

CROSS-REFERENCE TO RELATED APPLICATION

Figure 1:
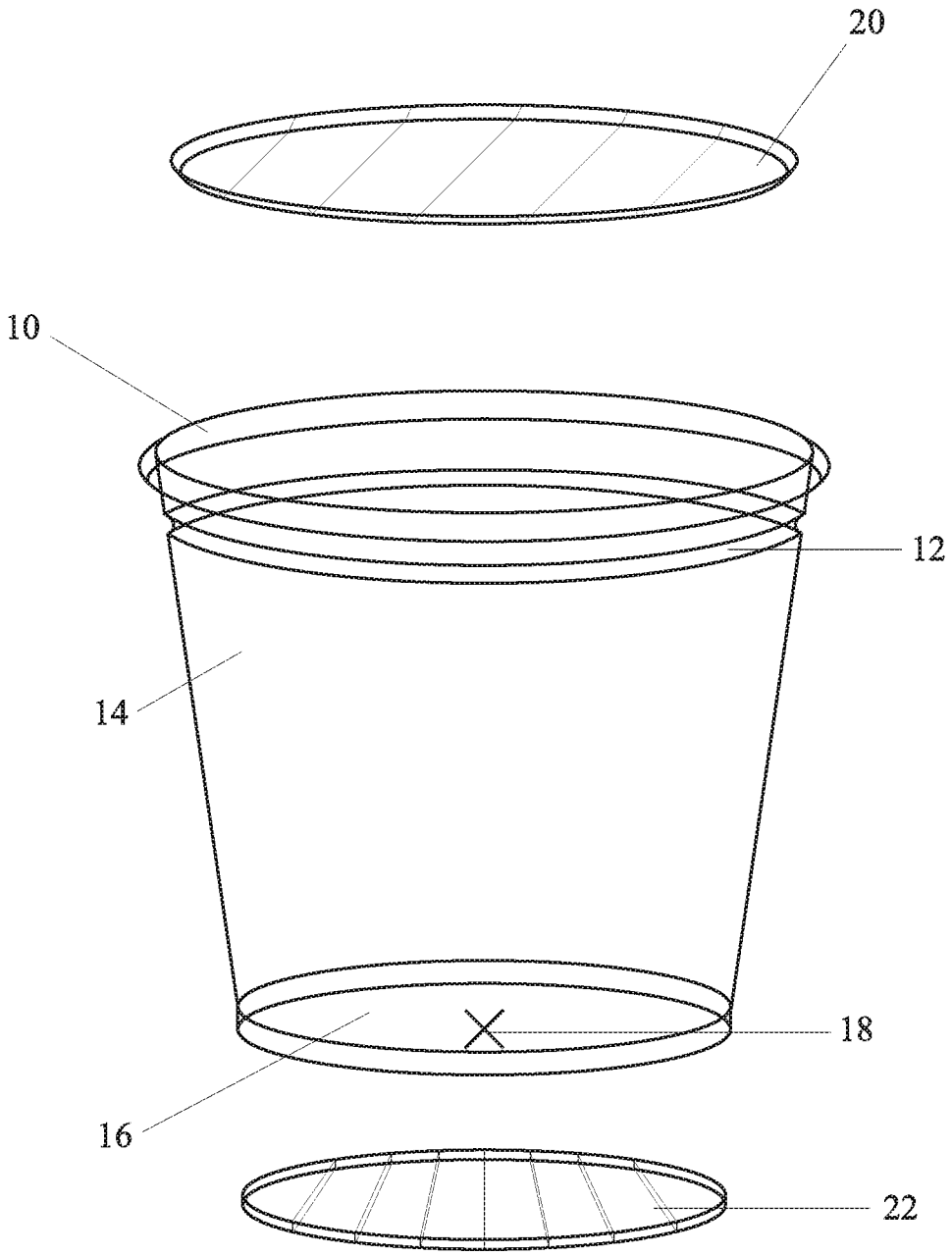

This application claims the benefit of U.S. Provisional Application No. 62/558,011, filed Sep. 13, 2017 and entitled "Cup with Hole", which is incorporated herein by reference in its entirety.

BACKGROUND

The fast food sector of the restaurant industry is characterized by, among other things, speed of service, portability of ordered food, and disposability of food containers. At many quick-service eateries, dine-in and take-out orders are served in the same disposable packaging. A dine-in order is traditionally delivered on a reusable tray while a take-out order usually comes bagged.

Disposable paper or plastic refillable cups are the norm at fast food restaurants. These cups are ordered and used in bulk just like napkins, utensils and bags. Yet unlike napkins, utensils and bags, disposable cups are directly linked to the success of any fast food establishment. Beverage sales are a main source of revenue for restaurants. All threats to drink order volumes are a cause of concern; a problem to solve.

Over the last few decades, quick-serve restaurants have increased order volume by ceding beverage filing duties to customers. Where once a restaurant employee would fill and deliver a drink order, now a customer ordering a beverage with a meal gets the food and an empty disposable cup. At a customer-facing drink station, customers fill and refill their purchased cups by selecting from a myriad of choices.

There are trade-offs however. A self-service beverage bar allows for increased order volume, but a lot less oversight. Customers who request complimentary disposable water cups are known to fill and refill these cups not with water but with flavored beverages. This is theft. These customers imbibe for free in a good that restaurants are in business to sell. It is not uncommon to see signage plastered around fast food eateries to the effect: Please only fill water cups with water!

A need is apparent for a disposable cup that hinders the ease of indiscriminant filing. To dissuade beverage theft, the solution is two-fold: 1. Restaurant employees must fill this complimentary water cup; and 2. This cup must become single-use after assembly. Yet there are considerable constraints. This cup must be inexpensive to purchase and ship; be easy to use by customers and employees alike; and require little, if any, set-up costs or associated machinery to use.

When considering prior art in relation to the inventive subject matter, it is helpful to restate that the customer-facing self-service beverage station was a substantial shift to the standard operating procedures within the restaurant industry. This widespread shift is no more than 35 years underway. As such, the bulk of disposable cup prior art does not address the need for an inexpensive easy-to-use single-use beverage container.

The field of disposable liquid containers includes U.S. Pat. No. 2,948,453 to Drown, and U.S. Pat. No. 3,558,033 to Leeds. The inventive subject matter of these patents are both straws incorporated into disposable cups. These disposable cups do not hinder indiscriminant filing and refiling. And they are not able or intended to be configured as single-use beverage vessels.

U.S. Pat. No. 3,797,696 to Dibrell provides for a no-spill cup closure. The closure is a lid with a drinking slot therein that is assembled with a cup to create a tightly sealed beverage container. However, the cup part can function as a drinking vessel with or without the lid. The lid is not permanent, and thus does not hinder refilling of the cup.

U.S. Pat. No. 4,186,842 to Albert provides for a disposable cup that is covered with a lid that includes a release valve. The lid is not permanent, it snaps onto the top of the cup. As such, nothing precludes a user from snapping off the lid and refiling the cup with whatever beverage options are available.

U.S. Pat. No. 4,301,926 to Chung, and U.S. Pat. No. 5,007,231 to Ingemann provide for mass-produced containers that require machinery for final assembly. Consequently, the associated costs are prohibitive. Paying to ship filled single-use water containers that are complimentary is not a sound business practice. Even if these beverage vessels are assembled at individual fast food locations, the required machinery costs, which include on-going maintenance, are prohibitive.

None of the aforementioned prior art describe a disposable cup that accomplishes all of the following: 1. Hinders indiscriminant filing and refiling; 2. Is inexpensive to manufacture, purchase, and ship; 3. Is easy to use by a layperson; 4. Fits in seamlessly with the industry-standard processes of restaurants; and 5. Requires little to no supporting machinery to operate.

SUMMARY

The inventive subject matter overcomes the aforementioned problems by providing a low-cost disposable cup that is easy to fill and assemble by hand such that any drinker will have trouble refiling it when empty. The cup is configured such that drinking from it renders it difficult to refill.

The inventive subject matter provides for a cup with hole that has a wide opening with lip with an encasing side wall extending therefrom and ending at a top or bottom section with an incorporated drinking hole, and separate plugs that can be assembled therewith to create a drinking vessel. When a notch is incorporated into the encasing side wall, a permanent plug covers the wide opening with lip and drinking occurs via the drinking hole. With or without a notch, a permanent plug and a lid cover the wide opening with lip and drinking occurs via the drinking hole.

This inventive subject matter relates to disposable cups. The various embodiments and domains described herein should not be construed as limitations in the potential application of the inventive subject matter. Rather they are teachings for the purpose of illustrating the ramifications and variations of possible embodiments of this inventive subject matter. These and other embodiments are described in more detail in the following detailed descriptions and figures.

The foregoing is not intended to be an exhaustive list of embodiments and features of the present inventive subject matter. Persons skilled in the art are capable of appreciating other embodiments and features from the following detailed description in conjunction with the drawings.

DRAWINGS

The following figures show embodiments according to the inventive subject matter.

FIG. 1—Perspective view of the inventive subject matter disassembled.

Figure 2:
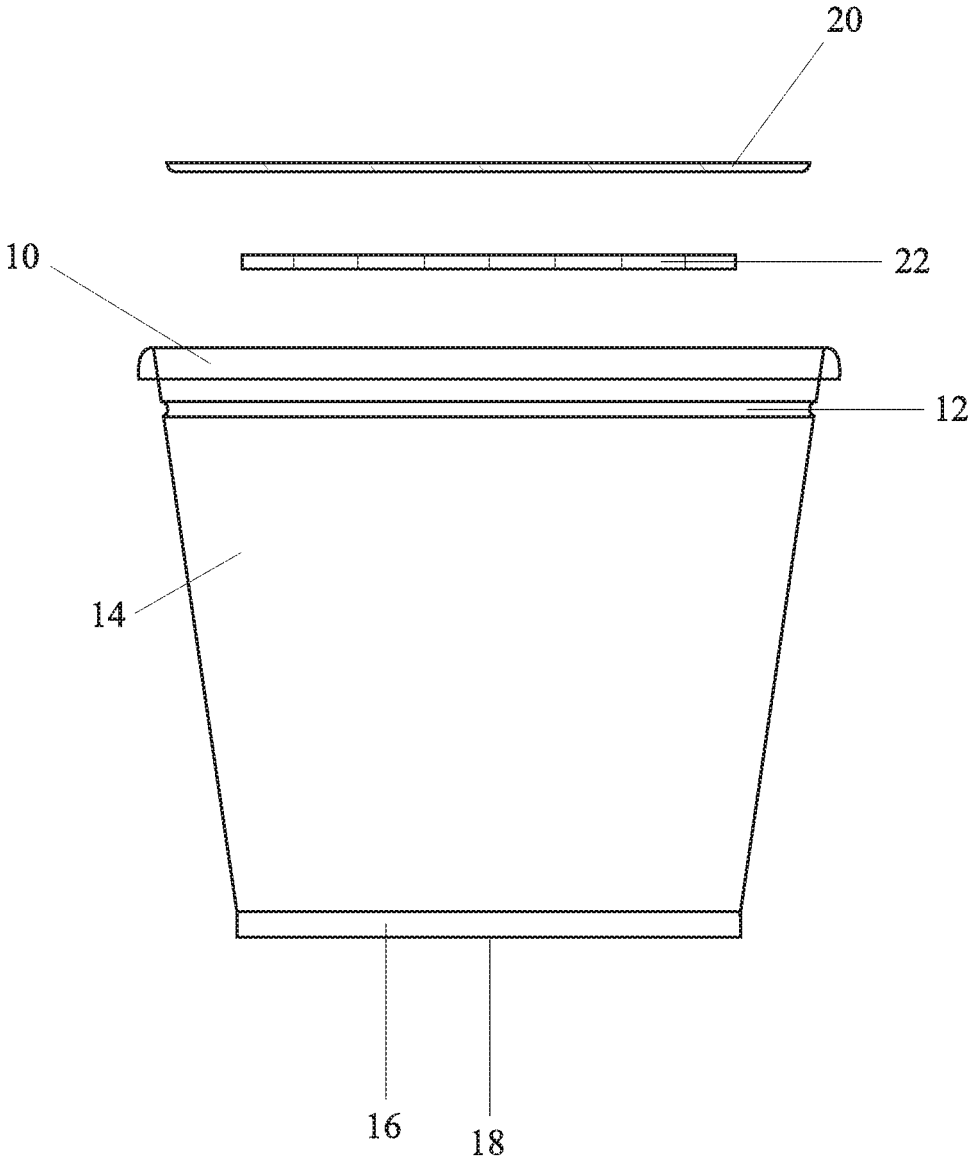

FIG. 2—Front view of the inventive subject matter disassembled.

Figure 3:
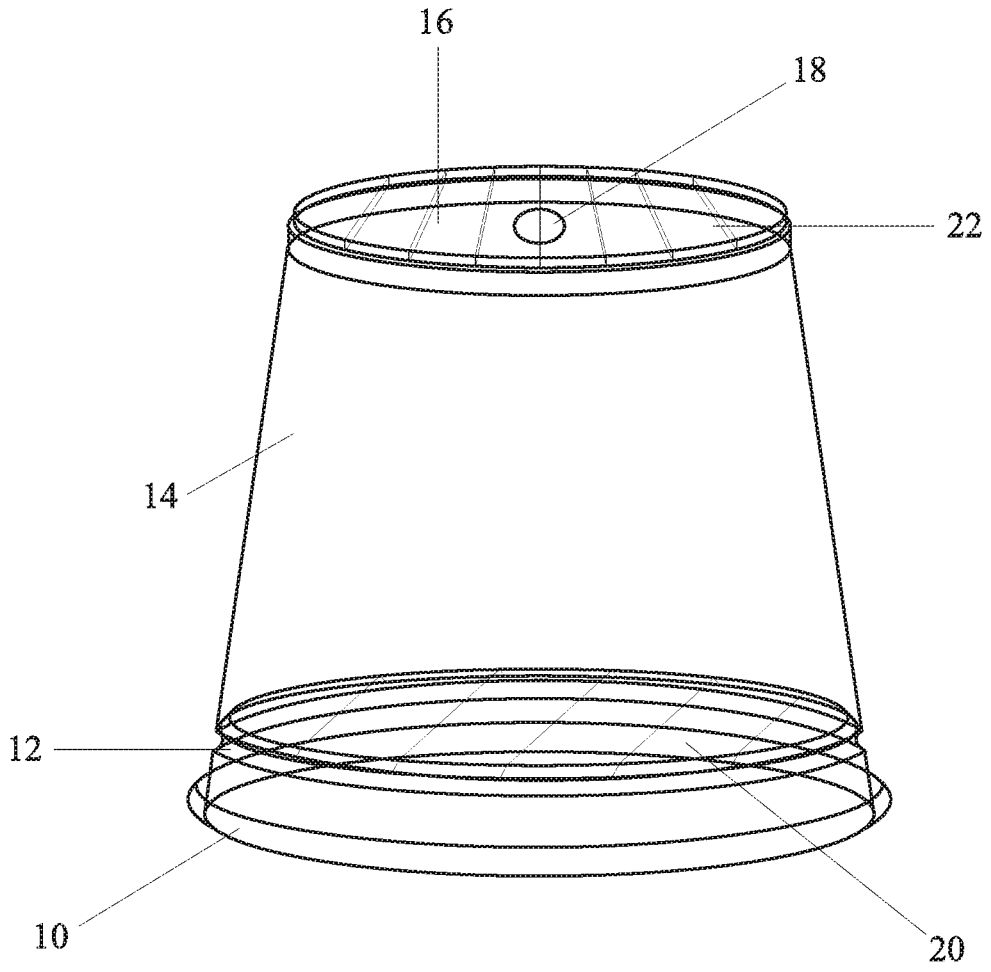

FIG. 3—Perspective view of the inventive subject matter assembled and inverted using a permanent plug to restrict flow through a wide opening with lip and a removable plug to restrict flow through a drinking hole.

Figure 4:
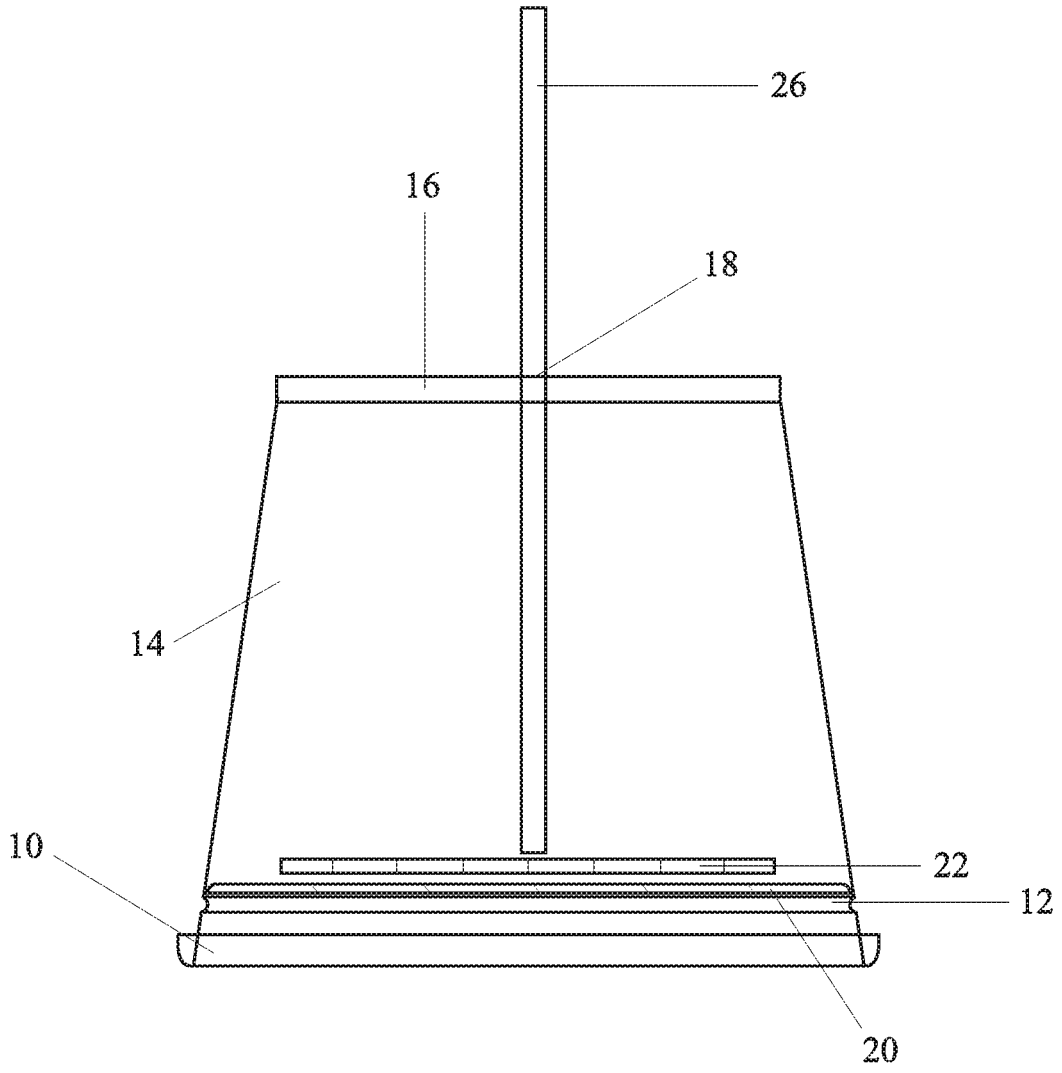

FIG. 4—Front view of the inventive subject matter assembled and inverted using a permanent plug to restrict flow through a wide opening with lip and a drinking straw inserted into a drinking hole to dislodge a removable plug.

Figure 5:
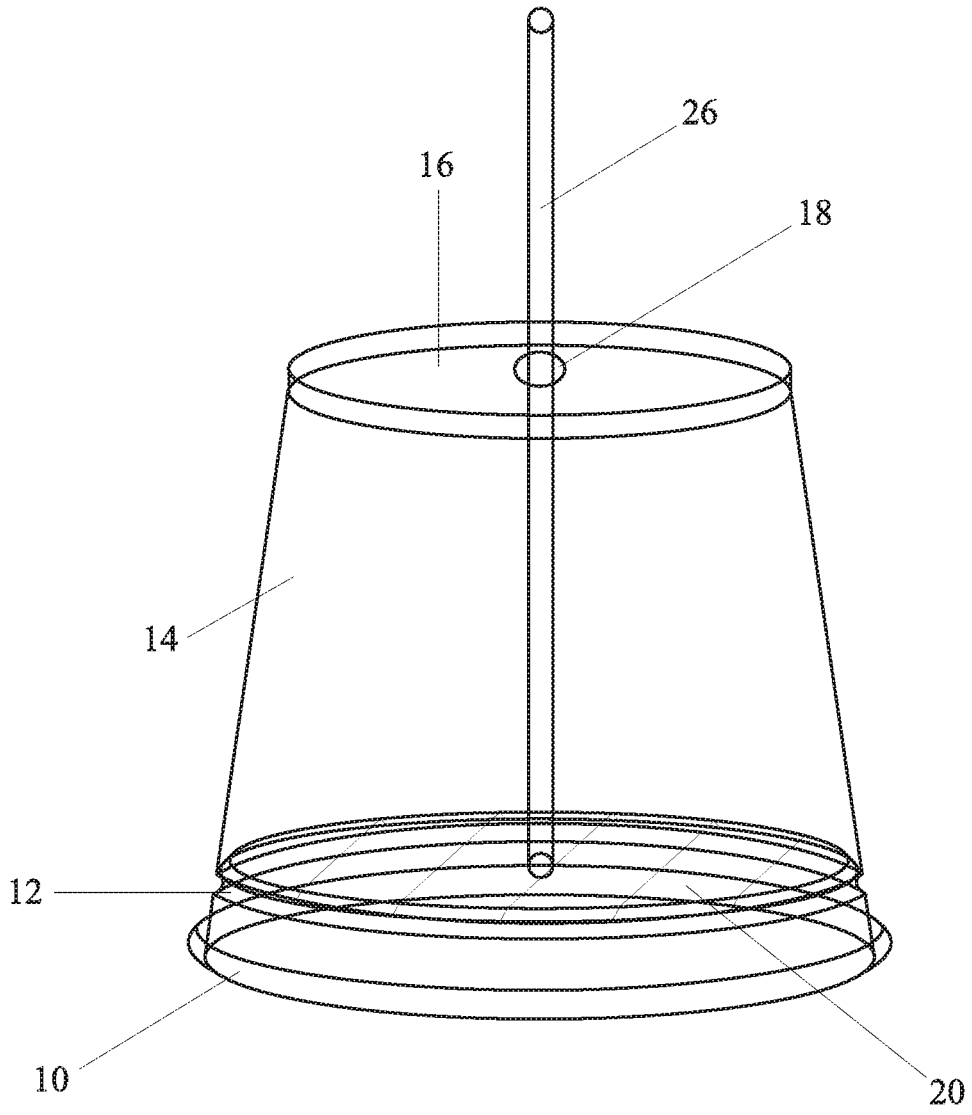

FIG. 5—Perspective view of the inventive subject matter assembled and inverted using a permanent plug to restrict flow through a wide opening with lip and a drinking straw inserted into a drinking hole.

Figure 6:
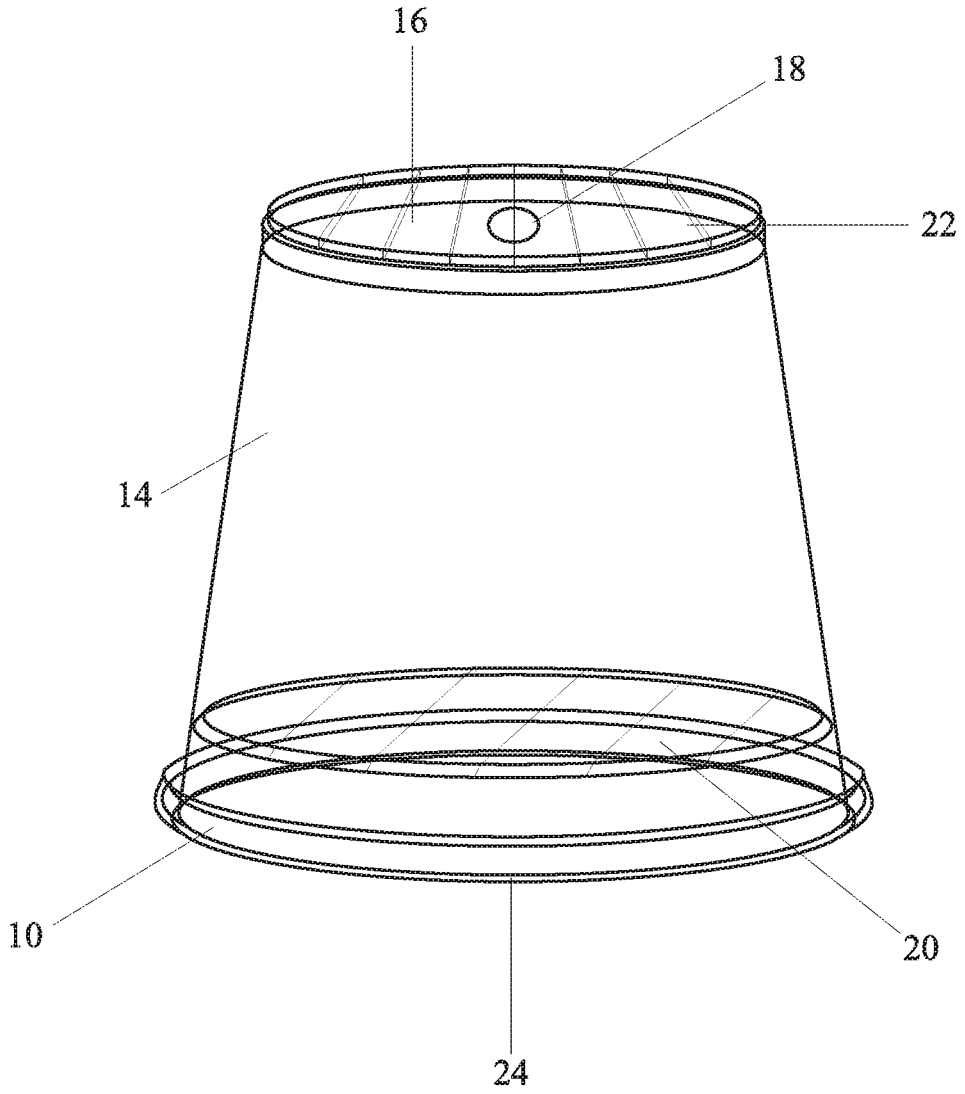

FIG. 6—Perspective view of the inventive subject matter assembled and inverted using a permanent plug and a lid to restrict flow through a wide opening with lip and a removable plug to restrict flow through a drinking hole.

Figure 7:
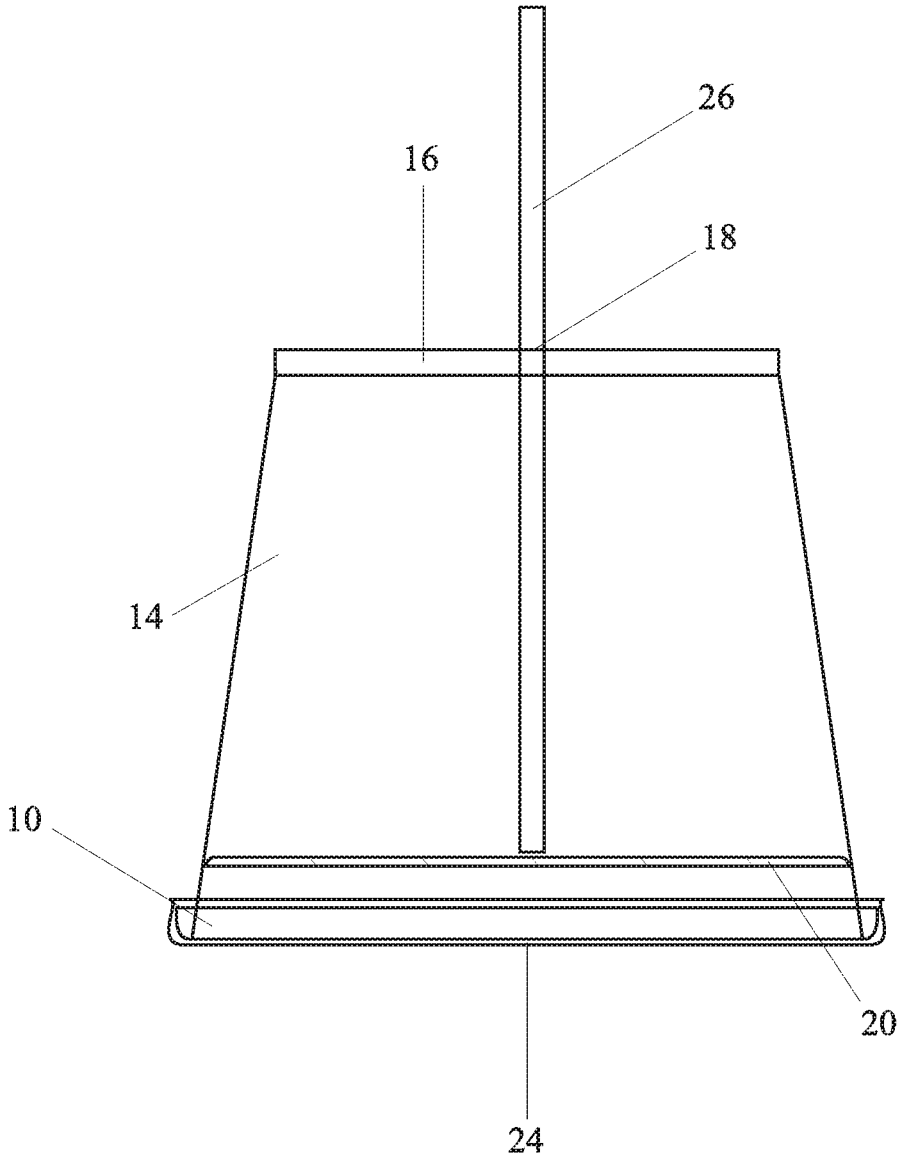

FIG. 7—Front view of the inventive subject matter assembled and inverted using a permanent plug and a lid to restrict flow through a wide opening with lip and a drinking straw inserted into a drinking hole.

REFERENCE NUMERALS IN THE DRAWINGS

10 wide opening with lip
12 notch
14 encasing side wall
16 top or bottom section
18 drinking hole
20 permanent plug
22 removable plug
24 lid
26 drinking straw

DETAILED DESCRIPTION

Representative embodiments according to the inventive subject matter are shown in FIGS. 1 to 7. The specific embodiments are meant to be illustrative and not limiting of the scope of the inventive subject matter and the various ways it may be embodied.

In accordance with the present inventive subject matter, the cup with hole has: 1. On one side, a wide opening with lip; 2. On the other side, a top or bottom section with a drinking hole therein; 3. In between, an encasing side wall that may incorporate a notch; and 4. Separate plugs—permanent and removable—that can be assembled thereto.

FIG. 1 and FIG. 2 illustrate different views of the inventive subject matter. In this embodiment, the cup with hole has a wide opening with lip 10, a notch 12 incorporated into an encasing side wall 14, a top or bottom section 16 with a drinking hole 18 therein. The permanent plug 20 and removable plug 22 are disassembled. All the illustrated parts are inexpensive to manufacture, purchase and ship.

Now referring to FIG. 3 and FIG. 4 that show the same embodiment as FIG. 1 and FIG. 2 but assembled and inverted. A permanent plug 20 is inserted into a wide opening with lip 10 and it compresses as it passes over a notch 12 incorporated into an encasing side wall 14. After passing entirely over the notch 12, the plug 20 is less compressed and stays in place. After assembly, the permanent plug 20 is difficult to remove. A removable plug 22 is affixed externally or internally to a top or bottom section 16 to restrict flow through a drinking hole 18. Once affixed, the removable plug 22 is easy to remove. All the illustrated parts are simple to assemble by a layperson using no machinery.

The steps to assemble the beverage cup embodied in FIGS. 1-4 are: 1. Plug the drinking hole 18 externally or internally using the removable plug 22; 2. Fill with liquid via the wide opening with lip 10; 3. Plug the wide opening with lip 10 using the permanent plug 20; 4. Invert; and 5. Serve. The beverage cup becomes single-use when drinkers dislodge the removable plug 22 in order to drink from the drinking hole 18. Due to its relatively small size, the unrestricted drinking hole 18 is suitable to drink from, but cumbersome to refill through. The removable plug 22 in FIG. 3 is external and can be peeled off by hand. The removable plug 22 in FIG. 4 is internal and has been dislodged by a drinking straw 26.

FIG. 5 is the same embodiment as FIGS. 1-4 but a removable plug 22 is not illustrated because it is not part of the final assembly that is served. The removable plug 22 can be a flat surface, such as a food preparation table. Downward pressure applied by hand to a wide opening with lip 10 restricts flow through a drinking hole 18 by keeping a top or bottom section 16 flat against the table. After liquid is filled and a permanent plug 20 is assembled, the resulting single-use beverage cup is quickly inverted and served.

The embodiment of the inventive subject matter in FIG. 6 and FIG. 7 is very similar to that of FIGS. 1-5. The only difference is a permanent plug 20 uses a lid 24 to stay in place, whereas in FIGS. 1-5, the permanent plug 20 uses the notch 12. All other aspects are the same including the end result, a simple and inexpensive single-use disposable cup.

The cup with hole can be made from any material that is suitable for containing consumable liquids. A few examples of many acceptable materials are polypropylene, plastic, or waxed paper.

All patent and non-patent literature cited herein is hereby incorporated by reference in its entirety for all purposes.

I claim:

1. A cup with hole apparatus that can be configured as a single-use beverage cup comprising:

a container constructed of an encasing side wall with a plurality of opposing ends;

each of the opposing ends incorporating one of a plurality of openings from which a liquid contained in the container can flow, with at least one of these openings being an opening well suited for the drinking of contained liquids;

the container is configured as a single-use beverage cup by assembling a removable flow restricting part to the opening well suited for the drinking of the contained liquid, and installing permanent flow restricting parts to all other openings;

the removable flow restricting part is removed to allow for drinking;

the plurality of openings comprises two openings, the two openings are a drinking hole and a wide opening with lip;

the removable flow restricting part is a removable plug for the drinking hole, the permanent flow restricting part is a permanent plug for the wide opening with lip;

the removable plug, which can be individual or configured from multiple parts, fits to a top or bottom section to restrict flow through the drinking hole, the permanent plug, which can be individual or configured from multiple parts, assembles with a notch incorporated into the encasing side wall to restrict flow through the wide opening with lip;

the removable plug is removed by hand or using a drinking straw to allow for drinking via the drinking hole.

2. A cup with hole apparatus that can be configured as a single-use beverage cup comprising:

a container constructed of an encasing side wall with a plurality of opposing ends;

each of the opposing ends incorporating one of a plurality of openings from which a liquid contained in the container can flow, with at least one of these openings being an opening well suited for the drinking of contained liquids;

the container is configured as a single-use beverage cup by assembling a removable flow restricting part to the opening well suited for the drinking of the contained liquid, and installing permanent flow restricting parts to all other openings;

the removable flow restricting part is removed to allow for drinking;

the plurality of openings comprises two openings, the two openings are a drinking hole and a wide opening with lip;

the removable flow restricting part is a removable plug for the drinking hole, the permanent flow restricting parts are a permanent plug and a lid for the wide opening with lip;

the removable plug, which can be individual or configured from multiple parts, fits to a top or bottom section to restrict flow through the drinking hole, the permanent plug, which can be individual or configured from multiple parts, assembles by fitting inside the encasing side wall beneath a lid attached to the wide opening with lip to restrict flow through the wide opening with lip;

the removable plug is removed by hand or using a drinking straw to allow for drinking via the drinking hole.

3. The cup with hole apparatus as described in claim 1 where:

the encasing side wall is frustoconical;

the notch incorporated into the encasing side wall is circumferential.

4. The cup with hole apparatus as described in claim 2 where:

the encasing side wall is frustoconical;

the notch incorporated into the encasing side wall is circumferential.

5. A cup with hole assembly method for a single-use beverage cup comprising:

procure a beverage cup with an opening with lip at the top, a drinking hole incorporated into a top or bottom section at the bottom, and an encasing side connecting the two;

fit a removable plug, which can be individual or configured from multiple parts, to the top or bottom section to restrict flow through the drinking hole;

fill the beverage cup with liquid via the opening with lip;

install a permanent plug, which can be individual or configured from multiple parts, by fitting it inside the encasing side wall beneath a lid attached to the opening with lip to restrict flow through the opening with lip;

invert the filled beverage cup;

the beverage cup becomes single-use once the removable plug is dislodged by hand or using a drinking straw to allow for drinking via the drinking hole.

* * * * *